US007518576B1

(12) United States Patent
Rutherford

(10) Patent No.: US 7,518,576 B1
(45) Date of Patent: Apr. 14, 2009

(54) POSITIVE COLUMN GAS DISCHARGE DISPLAY

(75) Inventor: James C. Rutherford, Fort Wayne, IN (US)

(73) Assignee: Imaging Systems Technology, Toledo, OH (US)

( * ) Notice: Subject to any disclaimer, the term of this patent is extended or adjusted under 35 U.S.C. 154(b) by 0 days.

(21) Appl. No.: 12/188,264

(22) Filed: Aug. 8, 2008

Related U.S. Application Data

(62) Division of application No. 10/980,183, filed on Nov. 4, 2004.

(60) Provisional application No. 60/520,298, filed on Nov. 17, 2003.

(51) Int. Cl.
*G09G 3/28* (2006.01)

(52) U.S. Cl. ..... 345/60; 345/66; 345/67; 345/68; 345/209; 345/215

(58) Field of Classification Search ..... 345/37–43, 345/60–69, 204–215
See application file for complete search history.

(56) References Cited

U.S. PATENT DOCUMENTS 3,769,543 A 10/1973 Pennebaker
3,836,810 A 9/1974 Johanns et al.
4,031,428 A 6/1977 Tokudome et al.
4,060,749 A 11/1977 Shinada et al.
6,184,848 B1 2/2001 Weber
6,323,830 B1 * 11/2001 Huang ..... 345/68
6,376,995 B1 4/2002 Kato et al.
6,528,952 B2 3/2003 Kato et al.
6,677,920 B2 * 1/2004 Huang et al. ..... 345/60
6,693,389 B2 2/2004 Marcotte et al.
6,768,478 B1 7/2004 Wani et al.
6,853,144 B2 2/2005 Marcotte
7,122,961 B1 10/2006 Wedding
7,157,854 B1 1/2007 Wedding
7,176,628 B1 2/2007 Wedding
7,268,749 B2 9/2007 Marcotte et al.
7,323,822 B2 1/2008 Marcotte
7,330,166 B2 2/2008 Marcotte

OTHER PUBLICATIONS

Weber, Positive Column AC Plasma Display, Conference Proceedings, Sep. 16-18, pp. 119-124, 23rd Internation Display Research Conference (IDRC 03), Phoenix, AZ, USA.

(Continued)

*Primary Examiner*—Vijay Shankar
(74) *Attorney, Agent, or Firm*—Donald K Wedding

(57) ABSTRACT

The luminous efficiency of a plasma display panel (PDP) device is increased by positive column gas discharge sustaining, with higher voltage and Xe content, plus pre-discharges sustain priming. High-speed addressing by using address period priming discharge. Cost saving in row driver ICs is realized by row addressing separated from sustaining. High contrast ratio due to masking of setup and addressing discharges.

10 Claims, 5 Drawing Sheets

Electrode Structure

OTHER PUBLICATIONS

Nagorny et al., Dielectric Properties and Efficiency of Positive Column AC PDP, Conference Proceedings, Sep. 16-18, pp. 300-303, 23rd Internation Display Research Conference (IDRC 03), Phoenix, AZ, USA.

Drallos et al., Simulations of AC PDP Positive Column and Cathode and Cathode Fall Efficiencies, Conference Proceedings, Sep. 16-18, pp. 304-306, 23rd Internation Display Research Conference (IDRC 03), Phoenix, AZ, USA.

Rutherford et al., PDP with Improved Drive Performance at Reduced Cost, Proceedings of the Ninth International Display Workshops, IDW '02, Dec. 4-6, 2002, pp. 837-840, Hiroshima,Japan.

Kaufman, Lamp Phosphors and Color Gamut in Positive-Column Gas-Discharge Cells for TV Displays, Proceeding of the S.I.D., First Quarter 1977, pp. 100-106, vol. 18/1.

* cited by examiner

Electrode Structure

POSITIVE COLUMN GAS DISCHARGE DISPLAY

RELATED APPLICATIONS

This is a division and continuation under 35 U.S.C. 120 of copending U.S. patent application Ser. No. 10/980,183, filed Nov. 4, 2004 with priority claimed under 35 USC 119(e) for Provisional Application Ser. No. 60/520,298, filed Nov. 17, 2003.

INTRODUCTION

This invention relates to a positive column plasma display panel including display panel electrode structure and method of operation. Color Plasma Display Panels (PDPs) have gained substantial market acceptance in recent years. Today the appearance of a PDP is better than that of a Color Picture Tube (CPT). However, before HDTV plasma displays will be accepted in the home market two issues must be resolved. Reductions of power consumption and cost are the two most important tasks needing improvement before HDTV plasma displays home acceptance.

"Cost reduction of the analog parts of the PDP module requires an improvement of the efficacy to the level of 3 lm/W. This will allow a power consumption of a complete 32-inch module of about 100 Watt. In commercial products already 2 lm/W has been achieved by Pioneer, while Philips has achieved 3.8 lm/W in test panels.

By actively pursuing a road towards higher panel efficiency and by finding ways to reduce data driving voltages, it will be possible to achieve the cost level needed to produce a complete 42-inch RGB-module for $1000, allowing the end user to buy the TV set for $3000". See Endnote [1] at the end hereof and incorporated herein by reference.

This PDP's power consumption requirement is reduced by improvements in luminous efficiency. Prior art methods used to improve luminous efficiency include positive column gas discharge sustaining, higher sustain voltages, higher Xe content, and pre-discharges sustain priming. See Endnote [2] at the end hereof and incorporated herein by reference.

BACKGROUND OF INVENTION

PDP Structures and Operation

In a gas discharge plasma display panel (PDP), a single addressable picture element is a cell, sometimes referred to as a pixel. The cell element is defined by two or more electrodes positioned in such a way so as to provide a voltage potential across a gap containing an ionizable gas. When sufficient voltage is applied across the gap, the gas ionizes to produce light. In an AC gas discharge plasma display, the electrodes at a cell site are coated with a dielectric. The electrodes are generally grouped in a matrix configuration to allow for selective addressing of each cell or pixel.

To form a display image, several types of voltage pulses may be applied across a plasma display cell gap. These pulses include a write pulse, which is the voltage potential sufficient to ionize the gas at the pixel site. A write pulse is selectively applied across selected cell sites. The ionized gas will produce visible light, or UV light which excites a phosphor to glow. Sustain pulses are a series of pulses that produce a voltage potential across pixels to maintain ionization of cells previously ionized. An erase pulse is used to selectively extinguish ionized pixels.

The voltage at which a pixel will ionize, sustain, and erase depends on a number of factors including the distance between the electrodes, the composition of the ionizing gas, and the pressure of the ionizing gas. Also of importance is the dielectric composition and thickness. To maintain uniform electrical characteristics throughout the display it is desired that the various physical parameters adhere to required tolerances. Maintaining the required tolerance depends on cell geometry, fabrication methods, and the materials used. The prior art discloses a variety of plasma display structures, a variety of methods of construction, and materials.

Examples of open cell gas discharge (plasma) devices include both monochrome (single color) AC plasma displays and multi-color (two or more colors) AC plasma displays. Also monochrome and multicolor DC plasma displays are contemplated.

Examples of monochrome AC gas discharge (plasma) displays are well known in the prior art and include those disclosed in U.S. Pat. Nos. 3,559,190 (Bitzer et al.), 3,499,167 (Baker et al.), 3,860,846 (Mayer), 3,964,050 (Mayer), 4,080,597 (Mayer), 3,646,384 (Lay), and 4,126,807 (Wedding), all incorporated herein by reference.

Examples of multicolor AC plasma displays are well known in the prior art and include those disclosed in U.S. Pat. Nos. 4,233,623 issued to Pavliscak, 4,320,418 (Pavliscak), 4,827,186 (Knauer, et al.), 5,661,500 (Shinoda et al.), 5,674,553 (Shinoda, et al.), 5,107,182 (Sano et al.), 5,182,489 (Sano), 5,075,597 (Salavin et al.), 5,742,122 (Amemiya, et al.), 5,640,068 (Amemiya et al.), 5,736,815 (Amemiya), 5,541,479 (Nagakubi), 5,745,086 (Weber), and 5,793,158 (Wedding), all incorporated herein by reference.

This invention may be practiced in a DC gas discharge (plasma) display which is well known in the prior art, for example as disclosed in U.S. Pat. Nos. 3,886,390 (Maloney et al.), 3,886,404 (Kurahashi et al.), 4,035,689 (Ogle et al.), and 4,532,505 (Holz et al.), all incorporated herein by reference.

This invention will be described with reference to an AC plasma display. The PDP industry has used two different AC plasma display panel (PDP) structures, the two-electrode columnar discharge structure, and the three-electrode surface discharge structure. Columnar discharge is also called co-planar discharge.

Columnar PDP

The two-electrode columnar or co-planar discharge plasma display structure is disclosed in U.S. Pat. Nos. 3,499,167 (Baker et al.) and 3,559,190 (Bitzer et al.). The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge PDP structure has been widely used in monochrome AC plasma displays that emit orange or red light from a neon gas discharge. Phosphors may be used in a monochrome structure to obtain a color other than neon orange.

In a multi-color columnar discharge PDP structure as disclosed in U.S. Pat. No. 5,793,158 (Wedding), phosphor stripes, or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP such as disclosed by Wedding 158, each light emitting pixel is defined by a gas discharge between a bottom or rear electrode x and a top or front opposite electrode y, each cross-over of the two opposing arrays of bottom electrodes x and top electrodes y defining a pixel or cell.

Surface Discharge PDP

The three-electrode multi-color surface discharge AC plasma display panel structure is widely disclosed in the prior art including U.S. Pat. Nos. 5,661,500 and 5,674,553, both issued to Tsutae Shinoda et al of Fujitsu Limited; U.S. Pat. No. 5,745,086 issued to Larry F. Weber of Plasmaco and Matsushita; and U.S. Pat. No. 5,736,815 issued to Kimio Amemiya of Pioneer Electronic Corporation, all incorporated herein by reference.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is subject to less electron bombardment than in a columnar discharge PDP.

Positive Column Discharge

In accordance with this invention, there is provided a positive column plasma display panel including PDP electrode structure and method of operation. Positive column discharge is known in the prior art. U.S. Pat. No. 6,184,848 (Weber) discloses the generation of a "positive column" plasma discharge wherein the plasma discharge evidences a balance of positively charged ions and electronics. The PDP discharge operates using the same fundamental principal as a fluorescent lamp, i.e., a PDP employs ultraviolet light generated by a gas discharge to excite visible light emitting phosphors. Weber 848 discloses the use of an inactive isolation bar between rows of pixels. In one embodiment of this invention, the inactive isolation bar is pulsed with voltages to electrically isolate the rows.

In the practice of this invention, cost savings are obtained by a positive column PDP including improved drive methods and electrode structure. More particularly, in accordance with this invention, there is provided high speed addressing with an erase-addressing operation and address period priming. This makes possible a single-scan HDTV high-resolution display. Without high-speed addressing, a dual-scan method which doubles the number of column data driver ICs is required for HDTV. Because ON state pixel dielectric wall voltage is a well-defined value, positive column discharge addressing using an erase-addressing operation is much easier to control than when using a write-addressing operation. This makes possible using much smaller addressing voltages for the driver ICs. Present PDPs have a narrow discharge gap that use transparent electrodes to fill space. This is done to reduce the amount of light output blocked by the sustain bus electrodes. The positive column gas discharge's narrow widely spaced sustain electrodes have no need for transparent ITO electrodes to fill in space.

In the practice of this invention as disclosed herein, row addressing is done by the row driver IC outputs selecting a single Row Scan electrode. These electrodes are located between Y Odd and Y Even sustain electrodes. Therefore, each Row Scan electrode is used in addressing the row above and below it. Cost saving in row scan driver ICs is realized because only one half the number of ICs is needed. Being independent from the sustain electrode, the ICs do not have to be designed to carry the high sustain currents. Also using an erase-addressing operation with address priming will substantially lower the voltage requirements for both the row scan and data driver ICs. Because higher luminous efficiency lowers overall power requirements and the selective erase-addressing operation with address priming reduces the driver ICs voltages, a reduction in drive electronics cost by more than a factor of two is possible.

In one specific embodiment of this invention, the positive column discharge PDP is a tubular PDP with one or more PDP tubes filled with ionizable gas.

RELEVANT PRIOR ART RELATED TO PDP POSITIVE COLUMN DISCHARGE

The following PDP Positive Column prior art is incorporated herein by reference.

*Positive Column AC Plasma Display*, U.S. Pat. No. 6,184,848 issued to Larry F. Weber, Matsushita Electric, Kadoma Osaka, Japan

*Positive Column AC Plasma Display*, Larry F. Weber, 23rd International Display Research Conference (IDRC 03), September 16-18, *Conference Proceedings*, pages 119-124, Phoenix Ariz.

*Dielectric Properties and Efficiency of Positive Column AC* PDP, Nagomy et al, 23rd International Display Research Conference (IDRC 03), Sep. 16-18, 2003, *Conference Proceedings*, P-45, pages 300-303, Phoenix, Ariz.

*Simulations of AC PDP Positive Column and Cathode Fall Efficiencies*, Drallos et al, 23rd International Display Research Conference (IDRC 03), Sep. 16-18, 2003, *Conference Proceedings*, P-48, pages 304-306, Phoenix, Ariz.

*PDP with Improved Drive Performance at Reduced Cost*, James C. Rutherford, et al, IDW '02, *Proceedings of the Ninth International Display Workshops*, International Conference Center Hiroshima Dec. 4-6, 2002, Hiroshima, Japan

RELEVANT PRIOR ART RELATED TO TUBULAR PDP

The following prior art references relate to the use of tubes in a PDP and are incorporated herein by reference.

U.S. Pat. No. 3,602,754 (Pfaender et al.) discloses a multiple discharge gas display panel in which filamentary or capillary size glass tubes are assembled and formed as a monolayer to form a gas discharge panel.

U.S. Pat. Nos. 3,654,680 (Bode et al.), 3,927,342 (Bode et al.) and 4,038,577 (Bode et al.) disclose a gas discharge display in which filamentary or capillary size gas tubes are assembled to form a gas discharge panel.

U.S. Pat. No. 3,969,718 (Strom) discloses a plasma display system utilizing tubes arranged in a side by side, parallel fashion.

U.S. Pat. No. 3,990,068 (Mayer et al.) discloses a capillary tube plasma display with a plurality of capillary tubes arranged parallel in a close pattern.

U.S. Pat. No. 4,027,188 (Bergman) discloses a tubular plasma display consisting of parallel glass capillary tubes sealed in a plenum and attached to a rigid substrate.

U.S. Pat. No. 5,984,747 (Bhagavatula et al.) discloses rib structures for containing plasma in electronic displays are formed by drawing glass performs into fiber-like rib components. The rib components are then assembled to form rib/channel structures suitable for flat panel displays.

U.S. Patent No. Application 2001/0028216A1 (Tokai et al.) discloses a group of elongated illuminators in a gas discharge device.

U.S. Pat. No. 6,255,777 (Kim et al.) and U.S. Patent No. Application 2002/0017863 (Kim et al.) of Plasmion disclose a capillary electrode discharge PDP device and a method of fabrication.

U.S. Pat. No. 6,545,422 (George et al.) discloses a PDP with a plurality of micro-components in a socket and sandwiched between two substrates.

Other George et al prior art include U.S. Pat. Nos. 6,646,388 (George et al.), 6,620,012 (Johnson et al.), 6,612,889 (Green et al.), and 6,570,335 (George et al.), all incorporated herein by reference.

Published patent applications by George et al include U.S. Patent No. Applications 2004/0004445 (George et al.), 2003/0164684 (Green et al.), 2003/0094891 (Green et al.), and 2003/0090213 (George et al.), all incorporated herein by reference.

U.S. Pat. Nos. 6,633,117 (Shinoda et al.), 6,650,055 (Ishimoto et al.), and 6,677,704 (Ishimoto et al.), disclose a PDP with elongated display tubes, all incorporated herein by reference.

European Patent 1,288,993 (Ishimoto et al.), also discloses a PDP with elongated display tubes and is incorporated herein by reference.

The following U.S. Patent Applications by Fujitsu Ltd. of Kawasaki disclose PDP structures with elongated display tubes and are incorporated by reference: 2004/0033319 (Yamada et al.), 2003/0214223 (Ishimoto et al.), 2003/0214224 (Awamoto et al.), 2003/0214225 Yamada et al.), 2003/0184212 (Ishimoto et al.), 2003/0182967 (Tokai et al.), 2003/0180456 (Yamada et al.), 2003/0122485 (Tokai et al.), 2003/0052592 (Shinoda et al.), 2003/0049990 (Yamada et al.), 2003/0048077 (Ishimoto et al.), 2003/0048068 (Yamada et al.), 2003/0042839 (Ishimoto et al.), 2003/0025451 (Yamada et al.), and 2003/0025440 (Ishimoto et al.).

OTHER PRIOR ART

Harm Tolner, "Color Plasma Display Manufacturing", Seminar Lecture Notes, 2002 SID, M-10/24 and M-10/25.

Kenichi Yamamoto, Hiroshi Kayijama, Keizo Suzuki, Shirun Ho, and Yoshimi Kawanami, "An Address-Voltage-Modulation Drive for High-Luminous-Efficiency ac-PDPs", SID'02, pp. 856-859 (2002).

Yoichi Sato, Kimio Amemiya, Nobuhiko Saegusa and Masataka Uchidoi, "A 50-in. Diagonal Plasma Display Panel with High Luminous Efficiency and High Display Quality", SID'02, pp. 1060-1063 (2002).

Tsutae Shinoda, Yoshimori Miyashita, Yoshimi Sugimoto and Kazuo Yoshikawa, "Characteristics of Surface-Discharge Color AC-Plasma Display Panels", SID 81 DIGEST, pp. 164-165, (1981).

Minori Yokozawa, Seiji Sega, and Hideomi Matsuzaki, "Color TV Display with AC-PDP', JAPAN DISPLAY'83, pp. 515-517, (1983).

Jun-Young Yoo, Byoung-Kuk Min, Dae-Jin Myoung, Ken Lim, Eun-Ho you, and Myoung-Ho Park, "High Speed-Addressing Method for Single-Scan of AC PDP", SID'01, pp. 798-801 (2001).

SPECIFIC EMBODIMENT AND BEST MODE

Figure 1:
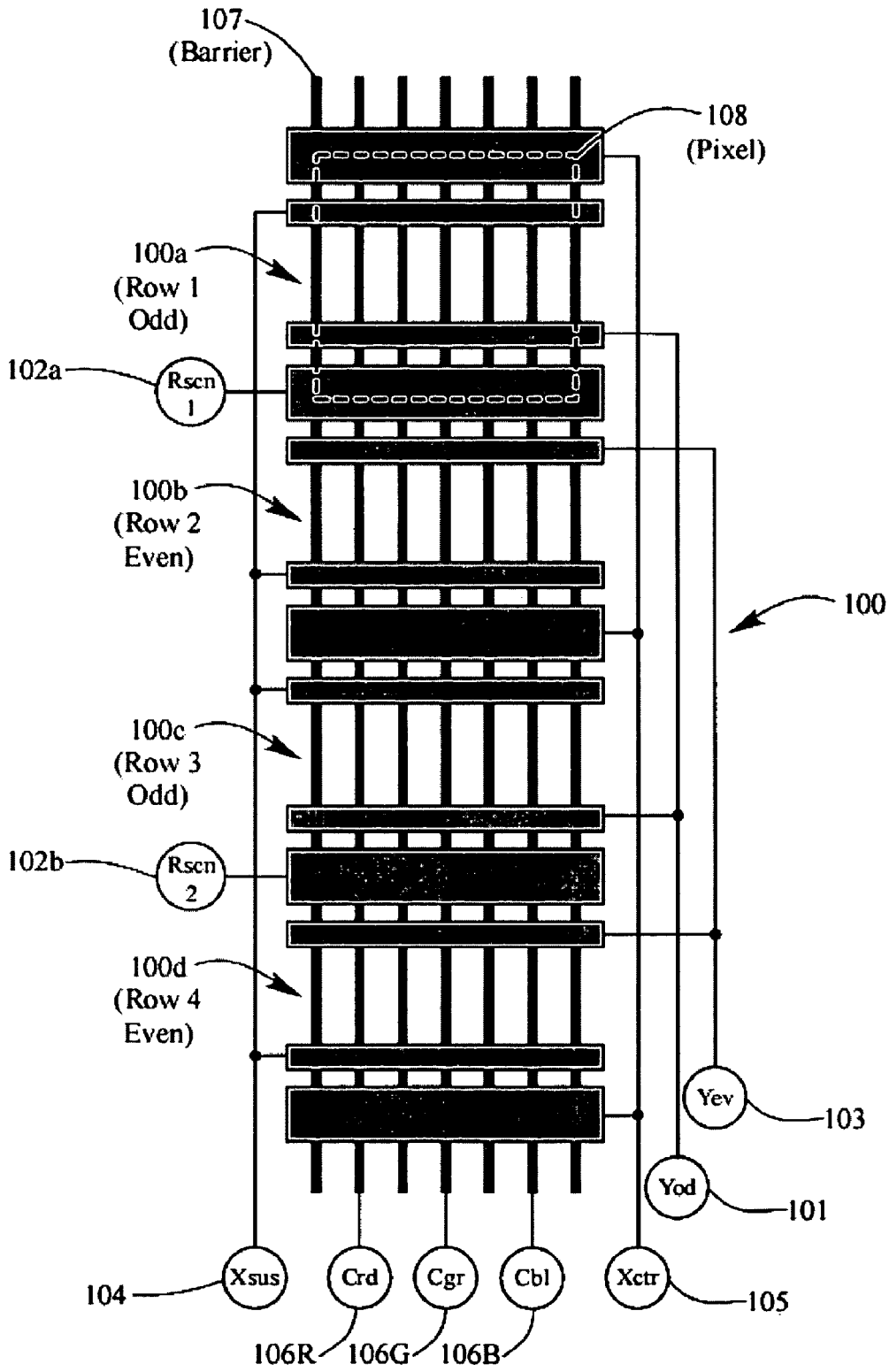
FIG. 1 illustrates an overview of an AC plasma display panel electrode structure with positive column discharge.

In a specific embodiment and best mode, there is used a positive column AC plasma display panel having Yodd and Yeven electrodes and odd and even rows with the display panel electrode structure comprising:

- a row scan electrode separate and between each pair of Yodd and Yeven sustaining electrodes for the displays odd and even rows,
- a pair of opposing X sustaining electrodes, one each for opposing the Yodd and Yeven sustaining electrodes, each X sustaining electrode pair having between them an X center electrode,
- and Column Data address electrodes positioned orthogonal and opposite the X sustaining, X center, Yodd, Yeven and Row scan electrodes.

In one embodiment, the row scan electrode is electrically pulsed. In another embodiment, the X center electrode is electrically pulsed.

In another embodiment, the display contrast ratio is improved by the row scan electrodes and black strips masking the light output from the plasma discharges of the row scan conditioning and addressing.

In another embodiment, the display contrast ratio is improved by the X center electrodes and black strips masking the light output from the plasma discharges of the X sustaining conditioning.

In another embodiment, the AC plasma display is a tubular PDP comprising a multiplicity of tubes filled with an ionizable gas.

This invention also relates to a method for electronically addressing a positive column AC plasma display panel comprising a multiplicity of pixels with charge storage dielectric and having Yodd and Yeven electrodes and odd and even rows and having row scan and sustaining electrodes, a pair of X sustaining electrodes with an X center electrode between them, the pixels being in the ON or OFF state, the method comprising the steps of:

conditioning the odd row by pulsing the row scan electrodes high and pulsing the Y odd electrodes low so as to produce a negative charge on the dielectric for pixels in the row scan electrode location and positive charge on the dielectric for pixels in the Y odd electrode location;

addressing the odd row by selectively erasing the dielectric charge for pixels that are to be in the OFF state by individually selecting and pulsing each odd row with a low pulsed voltage in combination with a column high pulsed voltage;

reversing the dielectric charge at the Y odd sustain electrode location of ON state pixels by pulsing the row scan electrodes low and the Y odd electrodes high so as to set the correct dielectric charge for the initial positive column sustain cycle;

conditioning the even row by pulsing the row scan electrodes high and the Y even electrodes low so as to produce a negative charge on the dielectric for pixels in the row scan electrode location and a positive charge on the dielectric for pixels in the Y even electrodes;

conditioning the X sustaining by pulsing the X center electrode high and pulsing the X sustain electrode low to produce a negative charge on the dielectric for pixels in the X center electrode location and a positive charge on the dielectric for pixels in the X sustaining electrode location so as to set the correct dielectric charge for the initial positive column sustain cycle;

addressing the even row by selectively erasing the dielectric charge for pixels that are to be in the OFF state by individually selecting and pulsing each even row using a low pulsed voltage in combination with a column high pulsed voltage;

reversing the dielectric charge at the Y even sustain electrode location of ON state pixels by pulsing the row scan electrodes low and the Y even electrodes high so as to set the correct dielectric charge for the initial positive column sustain cycle;

pulsing the Y sustain electrodes low so as to provide a priming discharge between the row scan and Y sustain electrodes of pixels in the ON state;

pulsing the X sustain electrodes high so as to provide a priming discharge between the X sustain and X center electrodes;

pulsing the row scan electrode low and the X center electrode high so as to terminate the priming discharge at each electrode, the dielectric charges on the ON state pixels of the X sustain and Y sustain electrodes being initially set to opposite polarities and discharge so as to produce a positive column light emission;

and continuously sustaining the positive column discharge of the ON state pixels by pulsing both the X sustain and Y sustain electrodes so as to reverse the polarity of the dielectric charges at either end of the positive column, each subsequent positive column discharge producing light output.

In one embodiment of the method, the X center electrode pulse is ramped from a high level to a low level so as to erase dielectric charges on X sustain electrodes of OFF state pixels and eliminate priming discharges of OFF state pixels at the X sustain electrodes.

In another embodiment, there is provided a continuous sustain priming pulse by pulsing the row scan and X center electrodes while the Y sustain and X sustain electrodes are being pulsed.

DETAILED DESCRIPTION OF THE DRAWINGS

Electrode Structure

FIG. 1 shows the electrode structure for an AC plasma display 100 with odd and even rows 100*a*, 100*b*, 100*c*, and 100*d* and a multiplicity of pixels comprising a multiplicity of sub pixels 108 to be operated in the positive column discharge mode in accordance with this invention. Each row has a wide separation between the X sustain (Xsus) 104 and Y odd (Yod) 101 or Y even (Yev) 103 sustain electrodes for the positive column gas discharge sustaining. Row scan electrodes (Rscn) 102 are positioned between Yod 101 and Yev 103 sustain electrodes. The X Center electrodes (Xctr) 105 are located in the space between the adjacent Xsus 104 electrodes. High dark room contrast ratio is made possible by covering the area between rows with horizontal black strips (not shown). These strips mask unwanted light output from setup and addressing discharges.

Column Data electrodes 106 are used in addressing each sub-pixel. Full color RGB is addressed by the Column Data electrode (Crd) 106R (red), Column Data electrode (Cgr) 106G (green) and Column Data electrode (Cbl) 106B (blue). Also shown in FIG. 1 are barriers 107 that separate the sub-pixels.

The Row Scan electrodes 102 and Column Data electrodes 106 are the addressing electrodes. In this embodiment, the wide Row Scan electrode has a greater area facing to the Column Data electrode, which reduces the discharge delay [3]. The addressing electrodes are separate from and driven independently from sustain X and Y electrodes. Therefore this embodiment is an independent sustain/address type. All electrodes whose drive voltage pulses are in opposition have their electrode connections to opposite sides of the panel.

Figure 2A:
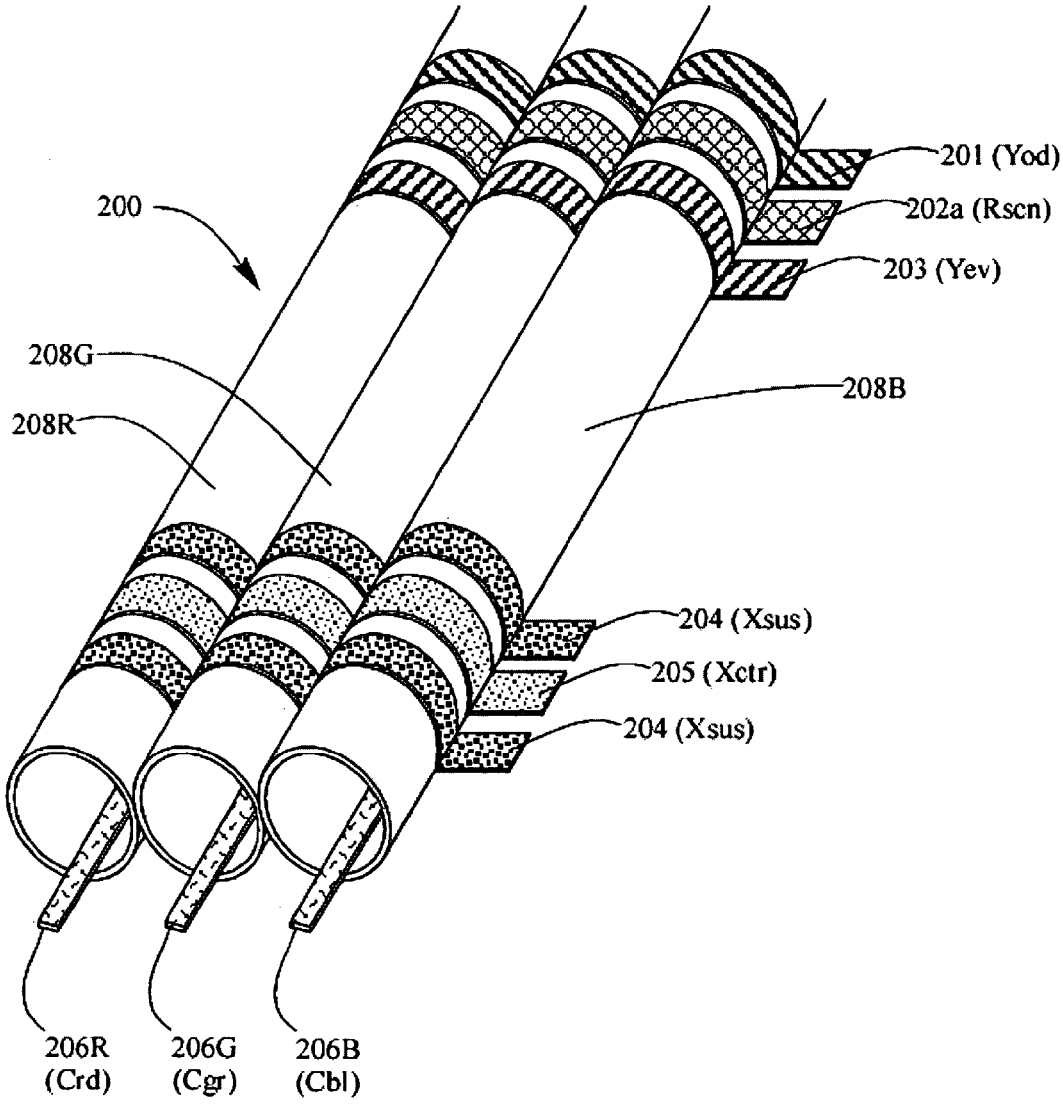
FIG. 2A illustrates the electrode structure for an AC plasma display pixel using tabulations.
Figure 2B:
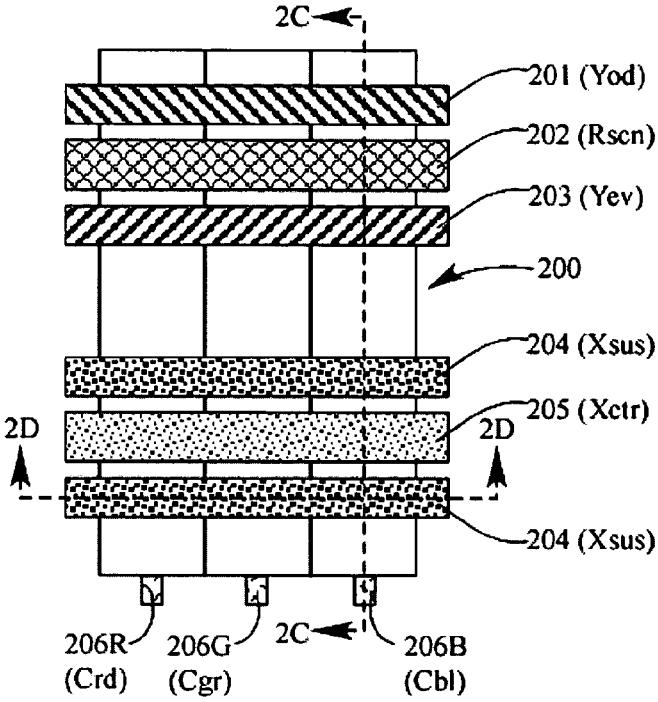
FIG. 2B illustrates the top view of the electrode structure of FIG. 2A.
Figure 2C:
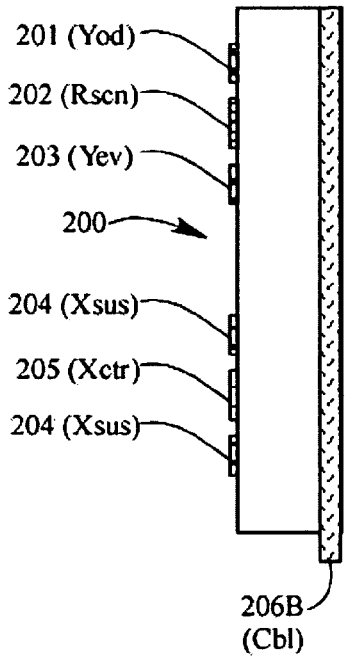
FIG. 2C illustrates a section 2C-2C view of the structure of FIG. 2B.
Figure 2D:
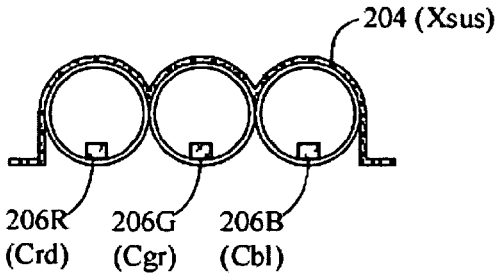
FIG. 2D illustrates a section 2D-2D view of the structure of FIG. 2B.

FIG. 2A shows a tubular PDP electrode structure 200 that illustrates a reduced portion of FIG. 1. As shown there are three tubes 208R, 208G, 208B filled with ionizable gas to define RGB pixels or sub pixels.

The RGB sub-pixels may be defined by a luminescent material located inside or outside each designated tube 208R, 208G, 208B. Each tube may contain a color gas such as an excimer and/or made from a color material such as tinted glass.

The display's row sustain electrodes, consisting of X sustain (Xsus) 204 and opposing Y odd (Yod) 201 or Y even (Yev) 203 sustain electrodes, have a distance separation between them. The separation is sufficient to allow positive column gas discharge sustaining, typically 800 or more microns. Row scan electrodes (Rscn) 202 are positioned between Yod 201 and Yev 203 sustain electrodes. The X Center electrodes (Xctr) 205 are in the space between the Xsus electrodes 204. During the setup or conditioning period plasma discharges produce unwanted light output at these electrodes. Also, during the addressing period unwanted light is produced at the Row Scan electrodes (Rscn) 202. While the X Center electrodes (Xctr) 205 and Row Scan electrodes (Rscn) 202 mask out a substantial portion of this unwanted light, further improvement is made possible by the addition of horizontal black strips (not shown) covering the area between the display's rows. The masking out of unwanted light and the use of black stripes results in a very high contrast ratio for the display.

Column Data electrodes 206R, 206G, 206B are used in addressing each sub-pixel. Full color RGB is addressed by (Crd) 206R (red), (Cgr) 206G (green) and (Cbl) 206B blue electrodes.

The Row Scan and Column Data electrodes are the display's addressing electrodes. In this design the wide Row Scan electrode has a greater area facing to the Column Data electrode, which reduces the discharge delay See Endnote [3] at the end hereof and incorporated herein by reference. The addressing electrodes are separate from and driven independently from sustain X and Y electrodes. Therefore this design is a true independent sustain/address type. All electrodes whose drive voltage pulses are in opposition make their electrode connections to opposite sides of the panel.

Drive Scheme

Figure 3:
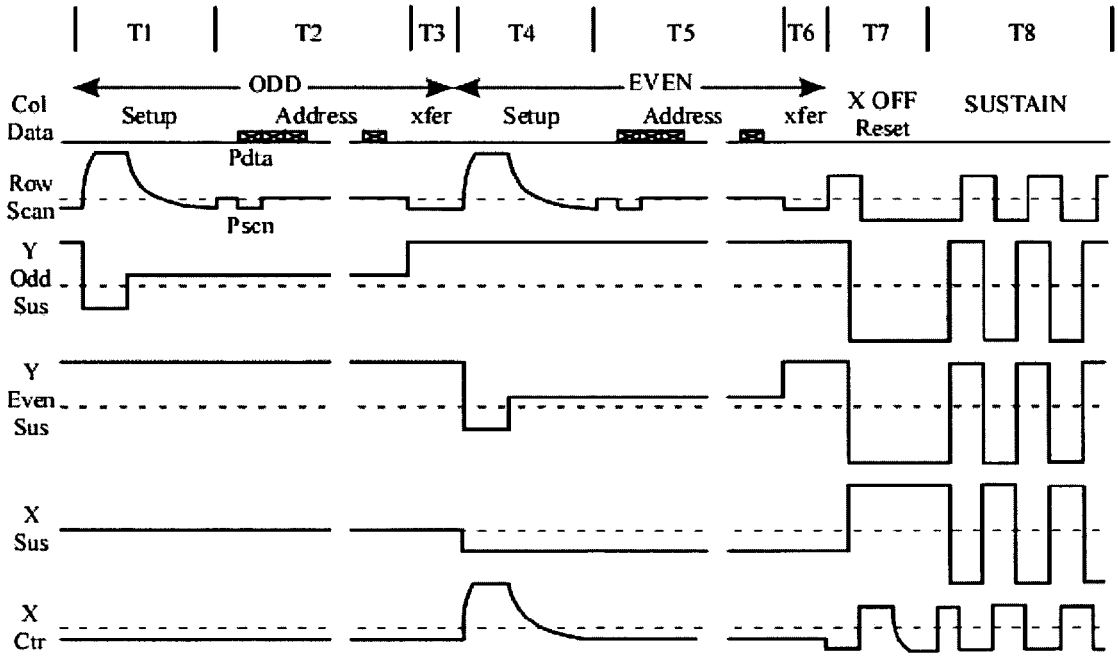
FIG. 3 illustrates drive waveforms for operating of a plasma display panel with positive column discharge.

FIG. 3 shows one set of driving waveforms. As shown in FIG. 3, the waveforms are divided into odd and even row periods consisting of setup (conditioning), selective erase-addressing operation and transfer. The X OFF Reset or conditioning period eliminates X sustain priming discharges in OFF cells. Last is the sustain period whose positive column gas discharge sustaining of ON cells produce the display light output.

Odd Row Setup or Conditioning

At the beginning of the waveforms the discharges from applying positive voltage pulses to the Row Scan electrodes 102 or 202 and negative voltage pulses to the Y Odd 101 or 202 sustain electrodes produce the wall charges used for the selective erase-addressing operation. The positive pulse's voltage on the Row Scan 102 or 202 electrodes is gradually reduced to avoid loss of this wall charge.

Odd Row Independent Addressing

Next is the address period were a discharge is produced by a column data positive voltage pulse (Pdta) and the negative voltage pulse (Pscn) on the selected Row Scan electrode. In these selected OFF cells, wall charge is removed from the Row Scan 102 or 202 and Column Data 106 or 206 electrode area. Thus, the selective erase-addressing operation removes the wall charge from cells that are to be OFF.

After completing the odd rows addressing, the transfer of ON cells wall charge is performed by applying a negative voltage pulse to the Row Scan 102 or 202 electrode and the Y Odd 101 or 201 Sustain electrode goes to a positive voltage level. The reason for doing this is to prevent any disturbance to the Y Odd 101 or 201 sustain electrode's wall charge during the even row address period. Also, the negative wall charge at the Y Odd sustain electrode will be the correct polarity for generating the first positive column gas discharge.

Even Row Setup or Conditioning

In this period the Row Scan 102 or 202 electrode voltage is pulsed positive and the Y Even 103 or 203 Sustain electrode voltage is pulsed negative causing a discharge that puts a wall charge at these electrodes. Also, during this time the X Sustain 104 or 204 electrodes voltage goes negative and the X Ctr 105 or 205 electrode voltage is pulsed positive producing a discharge. The resultant positive wall charge at the X sustain 104 or 204 electrodes is needed for the first positive column gas discharge sustain.

Even Row Independent Addressing

The same address method used for the odd rows is repeated for the even rows. After all even rows have been scanned; the Row Scan 102 or 202 electrode voltage is pulsed negative, while the Y Even 103 or 203 sustain electrode voltage goes positive causing a discharge of all ON cells. The transfer of wall charges puts a negative wall charge at the Y Even 103 or 203 Sustain electrode, which is the correct polarity for the first positive column gas discharge.

X OFF Reset

During the X OFF Reset period there is one positive column gas discharge sustain of all ON cells when the Y sustain electrodes voltage goes negative while the X sustain electrodes voltage goes positive. This results in a negative wall charge at the ON cells X sustain 104 or 204 electrodes; while the OFF cells X sustain 104 or 204 electrodes still maintain their previous positive wall charge. An erase voltage pulse on the X Center 105 or 205 electrodes is used to remove the positive wall charge from the X sustain OFF cells. The removal of this positive wall charge will prevent the X sustain OFF cells from having unnecessary pre-discharges sustain priming in the subsequent positive column gas discharge sustaining cycles.

Sustain

The X and Y sustain voltage pulses have both a positive and a negative component. The result is much higher sustain voltage capability (>450 volts), without unwanted discharges to the Row Scan 102 or 202, X Center 105 or 205 and/or the Column Data 106 or 206 electrodes.

To create the pre-discharges sustain priming the row scan voltage pulse transition is delayed by a small amount from that of the Y odd and Y even sustain voltage pulse transition. The result of this delay is a limited discharge between these electrodes. This limited discharge furnishes priming particles to the Y sustain electrodes. This same technique is used for the X Center and X sustain electrodes to furnish priming particles to the X sustain electrodes. Pre-discharges sustain priming at both X and Y sustain electrodes speeds up the positive column gas discharge sustaining.

During the sustain period, the electric field of the X and Y sustain electrodes drop above the Row Scan 102 or 202 and X Center 105 or 205 electrodes. This drop in electric field between display rows suppresses the sustain discharges from spreading into adjacent display rows. See Endnotes [4,5] at the end hereof and incorporated herein by reference.

Higher sustain voltage and Xe content is possible because of the improved addressing and sustain margins of this display drive method. The higher luminous efficiency resulting from this contributes to the reduction in power consumption and to drive electronics cost.

The following refers specifically to FIG. 3 and the time periods T1 though T8.

T1 (Odd Row Setup)

For odd row setup (conditioning), the Rscn electrodes are pulsed high and Yod electrodes are pulsed low producing a negative wall charge in Rscn electrode location and a positive wall charge on Yod electrode locations.

T2 (Odd Row Addressing)

Odd row addressing is performed by selective erasing of the wall charge for pixels that are to be OFF. This is performed by individually selecting each odd row with a low pulse voltage in combination with a column pulse high voltage.

T3 (Reversal of Wall Charge of Odd Row Pixel Set-Up)

Wall charge is reversed to set the correct wall charge for the initial positive column sustain cycle. This reversal also prevents a disturbance to the wall charge in the subsequent addressing of the even rows. This is accomplished when the Rscn voltage is pulsed low and the Yod voltage is pulsed high. This results in a positive wall charge on the Rscn at the electrode location and a negative wall charge at Yod electrode location.

T4 (Even Row Set Up)

For even row setup (conditioning), the Rscn electrodes are pulsed high and Yev electrodes are pulsed low producing a negative wall charge in the Rscn electrode location and a positive wall charge in the Yev electrode locations. In addition, the Xctr electrode is pulsed high and the Xsus electrode is pulsed low. These pulses provide a positive wall charge at the sustain electrode location. This also sets up and a negative wall charge at the Xctr electrode locations.

T5 (Even Row Addressing)

Even row addressing is performed by selective erasing of the wall charge for pixels that are to be OFF. This is performed by individually selecting each even row using a low pulse voltage in combination with a column high pulse voltage.

T6 (Reversal of Use Charge on Even Pixels Set-up)

Wall charge is reversed to set the correct wall charge for the initial positive column sustain cycle. This is accomplished where the Rscn voltage is pulsed low and the Yev voltage is pulsed high. This results in a positive wall charge on the Rscn at the electrode locations a negative wall charge at the Yev sustain electrode location.

T7 (Positive Column Sustain Discharge and Predischarge Priming.)

A priming discharge between the Rscn and the Ysus electrodes of ON pixels is established by first pulsing the Ysus electrodes low. A priming discharge between Xsus and Xctr is likewise established by pulsing the X sus electrode high. This produces a priming discharge at the X sustain electrodes and the Y sustain electrodes. These discharges are terminated by the pulsing the Rscn electrode low and the Xctr electrode high. This priming discharge enhances subsequent positive column discharge between the Ysus and Xsus pixels that are selected to be on. The wall charges of the Xsus and Ysus electrode are initially set to opposite polarities and discharge producing a positive column light emission. In addition, a ramp of the Xctr electrode pulse form a high level to a low level will erase the wall charge on X sustain electrodes of OFF pixels. This eliminates priming discharge of OFF state pixels at the Xsus electrodes.

T8 (Continuous Positive Column Sustain)

Continuous sustained discharge of positive column output as described in the priming and sustain of T7. The polarity for the Xsus and Ysus reverses with each subsequent discharge producing the light output.

Addressing Priming

Figure 4:
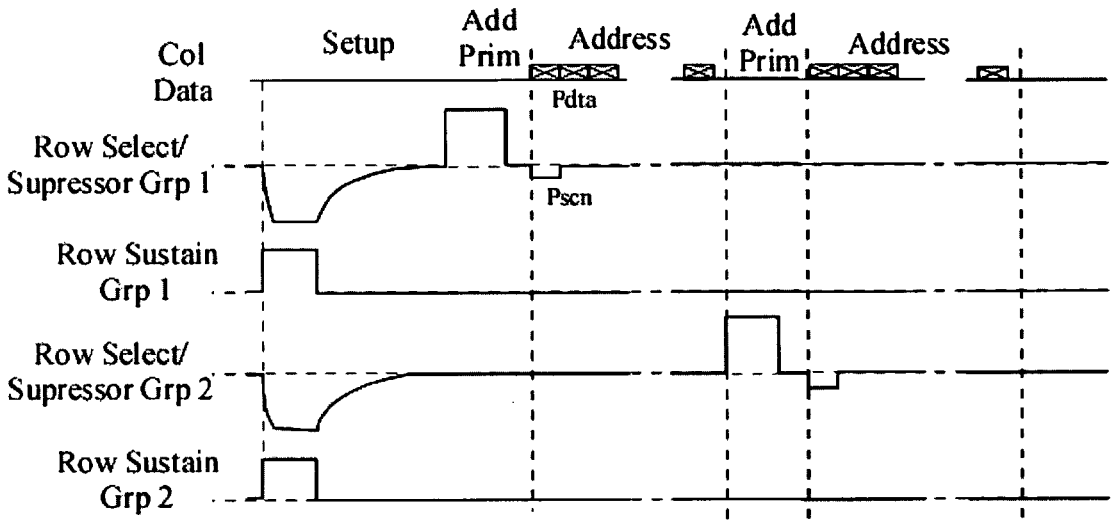
FIG. 4 illustrates address priming waveforms.

FIG. 4 shows addressing priming waveforms for the high-speed addressing method. FIG. 4 shows only two Row Scan Groups, but in an actual display the number of groups will be based upon the total number of rows to be scanned and how fast the priming particles decay after the address priming voltage pulse.

The polarity of the Setup (conditioning) voltage pulses in FIG. 4 is reversed from that in FIG. 3, because of the required additional discharge produced by the address priming voltage pulse. This additional discharge also improves the uniformity of the wall charge. Each row scan group has an address priming voltage pulse just before its selective erase-addressing operation. The increased priming from these discharges and using selective erase-addressing operation enables one microsecond row scanning addressing. See Endnote [6] at the end hereof and incorporated herein by reference.

SUMMARY

The improved drive performance proposed should result in a luminous efficiency capability of greater than 6 lm/W, which will reduce power consumption below that of a CPT. Cost savings resulting from lower power consumption, fewer row driver ICs, improved operating margins and an electrode structure that does not need ITO help reduce costs below the $3000 upper limit for high-end TV set.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. In a method for electronically addressing a positive column AC plasma display panel comprising a multiplicity of pixels with charge storage dielectric and having Yodd and Yeven electrodes and odd and even rows and having row scan and sustaining electrodes, a pair of X sustaining electrodes with an X center electrode between them, said pixels being in the ON or OFF state, the improvement which comprises:

conditioning the odd row by pulsing the row scan electrodes high and pulsing the Y odd electrodes low so as to produce a negative charge on the dielectric for pixels in the row scan electrode location and positive charge on the dielectric for pixels in the Y odd electrode location;

addressing the odd row by selectively erasing the dielectric charge for pixels that are to be in the OFF state by individually selecting and pulsing each odd row with a low pulsed voltage in combination with a column high pulsed voltage;

reversing the dielectric charge at the Y odd sustain electrode location of ON state pixels by pulsing the row scan electrodes low and the Y odd electrodes high so as to set the correct dielectric charge for the initial positive column sustain cycle;

conditioning the even row by pulsing the row scan electrodes high and the Y even electrodes low so as to produce a negative charge on the dielectric for pixel in the row scan electrode location and a positive charge on the dielectric for pixels in the Y even electrodes;

conditioning the X sustaining by pulsing the X center electrode high and pulsing the X sustain electrode low to produce a negative charge on the dielectric for pixels in the X center electrode location and a positive charge on the dielectric for pixels in the X sustaining electrode location so as to set the correct dielectric charge for the initial positive column sustain cycle;

addressing the even row by selectively erasing the dielectric charge for pixels that are to be in the OFF state by individually selecting and pulsing each even row using a low pulsed voltage in combination with a column high pulsed voltage;

reversing the dielectric charge at the Y even sustain electrode location of ON state pixels by pulsing the row scan electrodes low and the Y even electrodes high so as to set the correct dielectric charge for the initial positive column sustain cycle;

pulsing the Y sustain electrodes low so as to provide a priming discharge between the row scan and Y sustain electrodes of pixels in the ON state;

pulsing the X sustain electrodes high so as to provide a priming discharge between the X sustain and X center electrodes;

pulsing the row scan electrode low and the X center electrode high so as to terminate the priming discharge at each electrode, the dielectric charges on the ON state pixels of the X sustain and Y sustain electrodes being initially set to opposite polarities and discharge so as to produce a positive column light emission;

and continuously sustaining the positive column discharge of the ON state pixels by pulsing both the X sustain and Y sustain electrodes so as to reverse the polarity of the dielectric charges at either end of the positive column, each subsequent positive column discharge producing light output.

2. The invention of claim 1 wherein the X center electrode pulse is ramped from a high level to a low level so as to erase dielectric charges on X sustain electrodes of OFF state pixels and eliminate priming discharges of OFF state pixels at the X sustain electrodes.

3. The invention of claim 1 wherein there is provided a continuous sustain priming pulse by pulsing the row scan and X center electrodes while the Y sustain and X sustain electrodes are being pulsed.

4. The invention of claim 1 wherein adjacent rows of pixels are separated by an inactive field suppression isolation bar which is an active electrode with pulsed voltages to electrically isolate the rows.

5. The invention of claim 4 wherein the pulsed voltages are pulsed in the same direction as the sustain voltages and at lower amplitude than the sustain voltage.

6. The inventions of claim 1, wherein a number of row scan electrodes are pulsed at a high amplitude sufficient to produce a discharge just prior to the addressing of the PDP display panel so as to maximize priming for addressing.

7. The invention of claim 6 wherein the increased priming enables addressing with narrower addressing pulses.

8. The invention of claim 1 wherein the X center electrode is electrically pulsed.

9. The invention of claim 1 wherein the display contrast ratio is improved by row scan electrodes and by black strips masking the light output from the plasma discharges of the row scan conditioning and addressing.

10. The invention of claim 1 wherein the display contrast ratio is improved by the X center electrodes and black strips masking the light output from the plasma discharges from the X sustaining and conditioning.

* * * * *